United States Patent [19]

Roerig et al.

[11] Patent Number: 5,015,336

[45] Date of Patent: May 14, 1991

[54] FELT TURNING SUCTION ROLL

[75] Inventors: Arnold J. Roerig, Beloit; Dale A. Brown, Milton, both of Wis.

[73] Assignee: Beloit Corporation, Beloit, Wis.

[21] Appl. No.: 429,536

[22] Filed: Oct. 31, 1989

[51] Int. Cl.[5] ..... D21F 3/10; D21F 7/00

[52] U.S. Cl. ..... 162/369; 34/117; 34/120; 162/193; 162/370

[58] Field of Search ..... 162/368, 372, 369, 363, 162/193, 370; 34/116, 117, 120, 123; 29/116.1, 121.1

[56] References Cited

U.S. PATENT DOCUMENTS

| | | | |
|---|---|---|---|
| 2,709,398 | 5/1955 | Beachler | 162/306 |
| 2,714,342 | 8/1955 | Beachler | 162/370 |
| 3,358,384 | 12/1967 | Gustafsson et al. | 34/111 |
| 3,630,838 | 12/1971 | Bryand et al. | 162/368 |
| 4,016,032 | 4/1977 | Kankaanpaa | 162/368 |
| 4,483,083 | 11/1984 | Chance | 34/113 |
| 4,492,044 | 1/1985 | Knutsen | 34/114 |
| 4,693,784 | 9/1987 | Aula et al. | 162/368 |
| 4,980,979 | 1/1991 | Wedel | 34/23 |

*Primary Examiner*—Karen M. Hastings

*Attorney, Agent, or Firm*—Dirk J. Veneman; Raymond Campbell; Gerald A. Mathews

[57] ABSTRACT

A felt turning roll for use in the dryer section of a papermaking machine has a stationary shaft extending outwardly from at least one end of a perforated roll shell. The stationary shaft extends inwardly from the end of the roll for only a short distance which is substantially less than half the length of the face width of the roll. The stationary shaft is bored to permit a source of sub-atmospheric air pressure to be applied to its exterior portion. The inner portion of the shaft has a valve, a seal near its inner end between it and the roll shell, and openings to permit the exposure of sub-atmospheric air pressure within the roll shell on either side of the seal. The use of short stationary shafts eliminates the center shaft which otherwise would extend for the length of the roll. The roll therefore has a higher first natural frequency, and the use of the seal between the bored shaft and the interior wall of the roll shell permits the roll to apply a strong vacuum pressure beneath an annular area of the roll face near at least one end of the roll to facilitate threading of the papermaking machine during the start-up procedure.

6 Claims, 1 Drawing Sheet

FELT TURNING SUCTION ROLL

BACKGROUND OF THE INVENTION

1. Field of the Invention

This invention relates to rolls for removing air from spaces in machinery which processes traveling webs. More specifically, this invention relates to a roll for withdrawing air from the spaces between rotating rolls in a papermaking machine wherein air which is moving with the traveling paper web or felt, or both, tends to cause disruptions in the unsupported span of tee paper web between locations of its support on rotating rolls or other machine components. Still more specifically, this invention relates to a so-called felt turning roll for use in the dryer section of a papermaking machine wherein the roll has no central core shaft and is specifically adapted to provide support and guidance for the narrow paper web strip which is passed through the machine initially during the start-up procedure.

2. Description of the Prior Art

In prior felt turning rolls, such as is currently used in papermaking machinery, a stationary center shaft extends for the length of the roll about which a perforated roll shell is rotatably mounted. The center shaft is hollow, or bored, to permit a source of sub-atmospheric air pressure to be connected with one end of the shaft. The shaft contains openings to permit the interior space of the roll shell to be exposed to the source of sub-atmospheric air pressure whereby air is drawn into the roll through the holes forming perforations in the roll shell and which are drilled through the roll shell in a uniform pattern. This permits the roll to draw air from the space surrounding the roll, commonly referred to as a pocket in a papermaking machine, to interrupt the movement and diminish the amount of air traveling with the dryer felt, thereby mitigating potential separation of the web from the felt.

Such a structure operates satisfactorily, but it has limitations and shortcomings. First, the roll usually contains two or more longitudinally extending seals which define one or more vacuum chambers which can be oriented as desired. This causes uneven seal wear due to thermal distortion and deflection. Secondly, considering the relative long length of all rolls in modern papermaking machines, which may extend for greater than 8 meters along the face length of the rolls, and considering the relatively small diameter typical of such felt turning rolls, which diameter may typically be about 60 cm, the rolls can vibrate at certain machine speeds due to the relatively low natural frequency of the center shaft. Of course, any such vibration in a papermaking machine is deleterious to the papermaking process.

SUMMARY OF THE INVENTION

The problems associated with previous designs of felt turning rolls are mitigated by this invention. In the apparatus of this invention, the roll has no shaft which extends from one end of the roll to the other. Instead, a relatively short, hollow sleeve-like shaft or cylindrical chamber extends into the roll shell from either or both ends of the roll. One or the other, or both, of the shafts has a bore extending into its interior from its outer end. A source of sub-atmospheric air, such as a vacuum fan, is connected with the bore to provide sub-atmospheric air pressure to the interior of the roll. The shaft preferably is in the form of a sleeve, tube or cylinder, the inward end of which has a plurality of openings, which preferably take the form of holes, which connect the bore, or inner space, of the shaft with the interior of the roll.

Near the inner end of the bored shaft, an annular seal is disposed between the shaft and the inner surface of the roll shell. At the end of the shaft is a valve which can be controlled from outside the roll. The valve permits the shaft bore to be selectively in or out of fluid communication with the interior of the roll beyond the annular seal. When the valve is closed, or nearly closed, the sub-atmospheric air pressure in the shaft bore is exposed more completely to the end of the roll intermediate the annular seal and the proximate end of the perforated roll face. Thus, a relatively narrow, annular area of the roll face over the perforations at one end thereof is exposed to sub-atmospheric air pressure when the valve is closed. This permits the end of the roll to be more effectively used to thread a narrow strip, or tail, of paper web during the web-threading process as the papermaking machine is started initially or after a sheet break.

When the valve is open, the entire inside of the roll shell is exposed to the sub-atmospheric air pressure and air is induced inwardly through the roll shell perforations, as desired, according to the selectively open position of the valve.

Since the shafts do not extend through the roll from one end to the other, the roll is lighter in the middle. Also, since the center shaft in prior types of felt turning rolls is necessarily smaller in cross section than the roll shell, there is a tendency, or potential, to deflect more than the roll shell, which causes the longitudinal seals of the roll to loose contact with the roll shell. Even more important is the fact that, in this invention, the absence of a relatively narrow inner shaft extending through the roll raises the first natural frequency of the roll assembly which might otherwise be low enough to cause the roll to vibrate at certain speeds of the papermaking machine.

Elimination of the center shaft also reduces the weight of the roll and the cost of its manufacture. Because a shaftless roll has a higher natural frequency, the felt turning roll diameter does not have to be sized according to the weight, size and natural frequency of the center shaft, which in turn affects the size and design of other components, such as bearings. Since the distance the sleeve-like shaft of this invention extends into the end of the roll shell is relatively short compared with its diameter, the deflection of its inner end is negligible.

Accordingly, it is an object of this invention to provide an improved felt turning roll for a papermaking machine.

It is another object of this invention to provide a felt turning roll which is specifically adapted to handle a relatively narrow strip of paper web during the web threading procedure.

Still another object of this invention is to provide a felt turning roll which is lighter than a felt turning roll having a center shaft extending for substantially the length of the roll.

A feature of this invention is a felt turning roll having relatively short shafts at either end which do not extend for the length of the roll.

Another feature of this invention is a felt turning roll having a valve to selectively provide sub-atmospheric air pressure to different longitudinal locations along the roll face.

These, and other objects, features and advantages of this roll will become obvious to those skilled in the art upon reading the description of the preferred embodiment in conjunction with the attached drawings.

DETAILED DESCRIPTION OF THE PREFERRED EMBODIMENT

Figure 1:
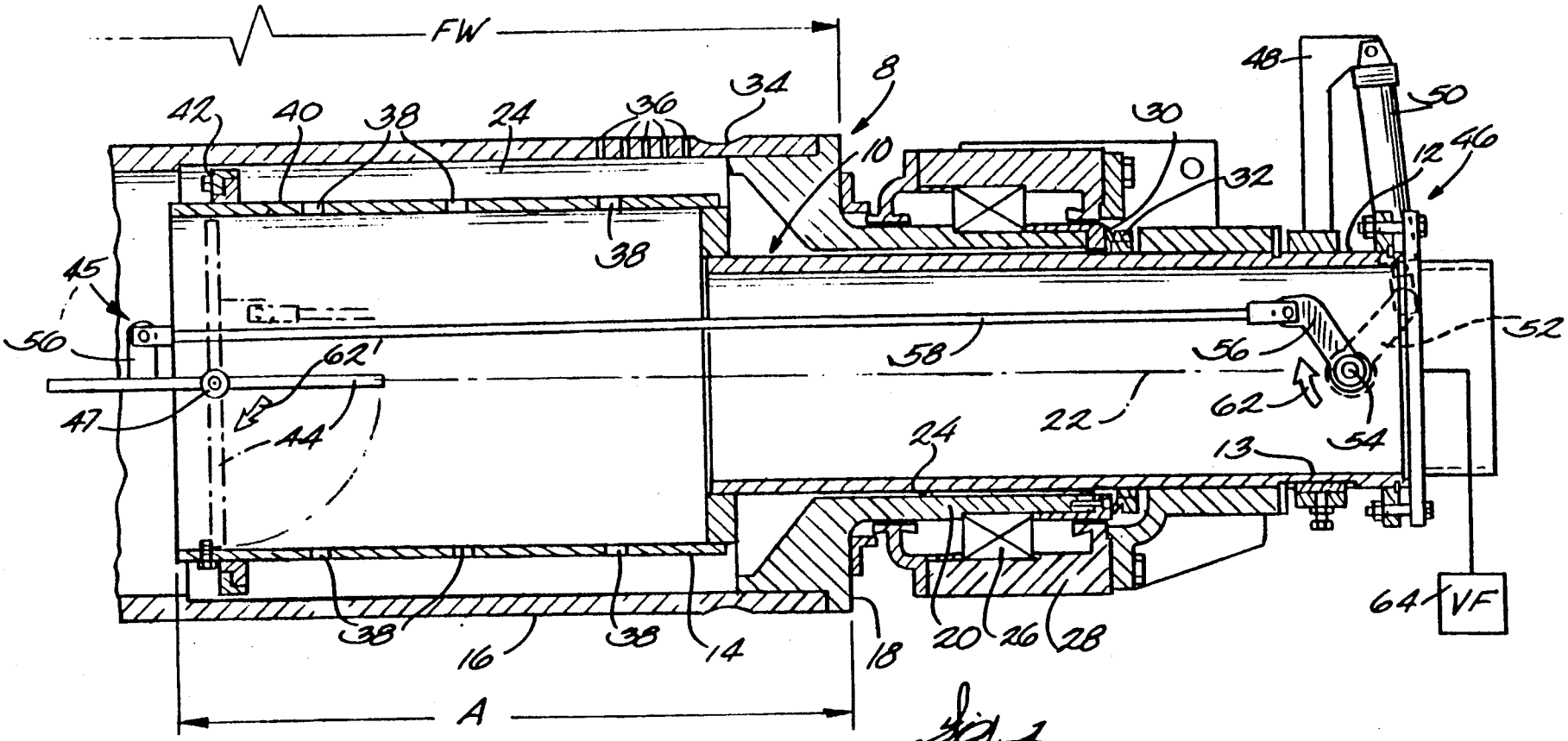
FIG. 1 is a side-elevational view, in section, of one end of the felt turning roll of this invention showing the valve in the end of the shaft and the valve actuation apparatus.

With reference to FIG. 1, a roll 8 having a shaft, generally designated with numeral 10, has a hollow, cylindrical outwardly extending portion 12 and a hollow, cylindrical inwardly extending portion 14. Although both portions 12,14 are preferably cylindrical, they need not be, although from a construction standpoint, as will become more clear in the subsequent description, they almost certainly will be cylindrical in any practical application.

A roll shell 16 is disposed about the shaft. An annular, tubular journal 18 is mounted to the end of the roll shell and has a cylindrical extension portion 20 which extends concentrically with the outwardly extending portion 12 of the shaft about the longitudinal axis 22 of the roll. A narrow, annularly cylindrical space 24 permits the journal and roll shell to rotate about the outwardly extending portion 12 of the shaft, which remains stationary. A bearing 26 is mounted in a bearing housing 28 and rotatably mounts the roll shell within the bearing housing via the extension 20 of the journal. An annular seal 30 mounted to a ring 32 on the outwardly extending portion 12 of the shaft 10 effectively seals the stationary shaft 10 relative to the rotating end of the collar extension 20. Shaft 10 is cantilever supported external of the roll 8 by an extension of bearing housing 28.

In this invention, the inner portion of the shaft extends inwardly from the end of the roll a distance A which might be about 30–90 cm and which is substantially less than the length of the face width FW of the roll which essentially extends inwardly from the end of the roll, over the rope groove 34 and over the length of the hole pattern perforating the effective face width with a plurality of small holes 36 drilled through the roll shell to the corresponding place on the other end of the roll. In other words, the effective face width essentially covers the length of the roll shell through which holes 36 are drilled. In any case, the length of the distance A that the shaft extends into the end of the roll is substantially less than half the distance of the roll face width FW. Within the inner portion 14 of the shaft 10, are a plurality of openings 38, such as holes, through its wall which permit fluid (i.e. air) communication between the inside of the tubular shaft and the space 24 between the outer surface 40 of the wall of the inner portion 14 of the shaft and the inner wall of the roll shell 16.

Near the inner end of the inner portion 14 of the shaft is a seal 42, which may be either a contact or clearance seal, which preferably is annular in shape but in any case establishes a seal between the outer surface 40 of the wall and the inner surface of the roll shell 16.

Within the inner portion 14 of the shaft, near the seal 42, is a plate 44 having a shape equal in size and shape to the cross-sectional shape of the open end of shaft portion 14. Thus, if the cross-sectional shape of inner portion 14 of the shaft is in its preferred form of a circle, then plate 44 is circular in shape. Plate 44 is pivotally supported in inner portion 14 on pivotal axle 47. The purpose of plate 44 is to cooperate with the end of inner portion 14 to function as a valve 45 in the end of the shaft to regulate the air pressure between the interior of inner portion 14 of the shaft and the interior of the roll 8 on the inboard side of plate 44.

At the outer end of the roll is an actuating apparatus generally designated with the numeral 46 which consists of a bracket 48, a fluid cylinder 50 having one end pivotally mounted to the bracket and the other end pivotally mounted to a lever arm 52 which has its other end pivotally attached to an axle 54 which is horizontally disposed and diametrally mounted in the outer portion 12 of the journal. A second lever arm 56 is also mounted to the axle 54 and is linked with the valve plate 44 via a rod 58 which is pivotally mounted to lever 56 on the plate 44.

Although the felt turning roll 8 can be perfectly symmetrical, that is have identical structural design, at either end, there is no requirement that the same shaft structure and the apparatus for applying sub-atmospheric air pressure be provided at both ends of the roll. In some applications, it is sufficient that the apparatus for providing sub-atmospheric air pressure be provided at only one end of the roll, and that is the end of the roll over which the narrow strip, or tail, of the web is brought over the end of the roll during the threading procedure. Thus, the journal 18, or outer portion 20 of journal 18, at the other end of the roll could be solid, or hollow with a closed end and extend outwardly from the end of the roll only for so long as is required to adequately rotatably mount the roll. In other applications, this apparatus for supplying increased edge vacuum can be provided at both ends of the roll. These end apparatus can then be used to provide additional vacuum restraint to the edge of the web.

In operation, air cylinder 50 may be actuated to extend its piston rod which rotates levers 52,56 clockwise in the direction of arrows 62,62' to close the butterfly-type valve 45 by bringing plate 44 into the vertical position shown with dashed lines. A source of sub-atmospheric air, such as schematically shown by vacuum fan 64, is brought into engagement with the opening 13 in the end of the outer portion 12 of the shaft, which opening may take the form of a relatively narrow bore extending from outside the shaft to valve 45. The bore in the inwardly extending portion 14 of the shaft is shown somewhat larger although it need not be larger in diameter. When the valve 45 is closed, sub-atmospheric air pressure is essentially maintained in the proximate end portion of the roll in space 24 beneath the perforations 36 in the roll shell via openings 38. This permits the tail being threaded through the papermaking machine to be received on the surface of the roll over space 24 and to be held thereon by the relatively high vacuum afforded over the relatively narrow annular area on the surface of the roll between seal 42 and the proximate end of the roll.

When the tail has been threaded, the valve 45 can be opened to any position between that shown by the plate 44 in its vertical dash position and its horizontal position by actuating the cylinder 50 to move the lever arms 52,56 in the counter-clockwise direction about their pivoted axle 54. As valve 45 is opened, the entire inside of the roll shell 16 is exposed to sub-atmospheric air pressure and the air from the pockets in the papermaking machine in which the roll is mounted is urged inwardly through the perforations 36 and openings 38 to be discharged through the shaft and outside the roll.

Thus, a felt turning roll whose structure and method of operation meets the objects of the invention has been shown and described. Naturally, various modifications of the structure can be made without departing from the spirit and scope of the invention which is limited only by the scope of the appended claims.

What is claimed is:

1. A felt turning roll for withdrawing air from the surroundings adjacent the periphery of the roll, comprising, in combination:

a perforated, hollow roll shell;

a journal mounted to each end of the roll shell and extending outwardly therefrom;

bearing means disposed about each journal and rotatably supporting the roll shell on the journals;

a stationary shaft extending inwardly into at least one end of the roll shell through and inwardly beyond the journal, each shaft extending for substantially less than the length of the roll shell, and at least one said shaft having a bore for establishing fluid communication from the end of the shaft outside the roll to within the interior of the shaft;

opening means in the interior end of each bored shaft for establishing fluid communication between the bore and the interior of the roll shell;

a seal between each bored shaft and the interior of the roll shell;

whereby sub-atmospheric pressure can be established in the bored shaft and the roll shell to urge air inwardly through the perforations for discharge outside the roll.

2. A felt turning roll as set forth in claim 1, wherein:

each shaft which has a bore defines a space between the shaft and the interior of the roll shell intermediate its seal and the proximate end of the roll shell;

whereby sub-atmospheric pressure established in the bored shaft is directed to the edge of the roll face beneath the perforations at that end of the roll for threading the web about the roll.

3. A felt turning roll as set forth in claim 1, wherein:

a stationary shaft extends inwardly into both ends of the roll shell.

4. A felt turning roll as set forth in claim 3, wherein:

each shaft has a bore for establishing fluid communication from the end of the shaft outside the roll to within the interior of the roll.

5. A felt turning roll for withdrawing air from the surroundings adjacent to the periphery of the roll, comprising, in combination:

a perforated, hollow roll shell;

a journal mounted to each end of the roll shell and having an extension which extends outwardly from the roll shell;

a bearing housing at each end of the roll;

a bearing disposed about each journal and rotatably supporting the roll shell thereon in the bearing housings;

a stationary shaft extending inwardly into each end of the roll shell through the extension of the journal, and inwardly beyond the journal, for a distance substantially less than half the length of the roll shell;

at least one said stationary shaft defining a space between the shaft and the interior wall of the roll shell and having a bore for establishing fluid communication from the end of the shaft outside the roll to within the interior of a shaft;

opening means in the interior end of at least one such bored shaft for establishing fluid communication between the bore and the space between each bored shaft and the roll shell;

a seal disposed inwardly of each bored shaft between the interior of the roll shell and the shaft for sealing at least a portion of each such space;

valve means in the bored shaft within the roll for selectively establishing fluid communication between the bore and the interior of the roll beyond the seal;

whereby sub-atmospheric pressure can be established in the bored shaft and within the roll selectively along the length of the roll shaft on either side of the seal to urge air inwardly through the perforations for discharge outside the roll.

6. A felt turning roll for withdrawing air from the surroundings adjacent the periphery of the roll, comprising, in combination:

a perforated, hollow roll shell;

a journal mounted to each end of the roll shell and extending outwardly therefrom;

bearing means disposed about each journal and rotatably supporting the roll shell on the journals;

a stationary shaft extending inwardly into both ends of the roll shell through and inwardly beyond the journal, each shaft extending for less than half the length of a roll shell, each of the shafts defining a space between the shaft and the interior wall of the roll shell, and each having a bore for establishing fluid communication from the end of the shaft outside the roll to within the interior of the shaft;

opening means in the interior end of each bored shaft for establishing fluid communication between the bore and the space between the shaft and the roll shell;

a seal inwardly of each such shaft between the interior of the roll shell and the shaft for sealing at least a longitudinally extending portion of each such space at either end of the roll shell;

valve means in each bored shaft within the roll for selectively establishing fluid communication between the bore and the interior of the wall beyond the seal;

whereby sub-atmospheric pressure can be established in the bored shaft and the proximate area over the corresponding end of the roll shell, and within the roll, selectively along the length of the roll shell on either side of the seal to urge air inwardly through the perforations for discharge outside of the roll, whereby the edges of the web are restrained.

* * * * *